US006910435B2

(12) United States Patent
Hadcroft et al.

(10) Patent No.: US 6,910,435 B2
(45) Date of Patent: Jun. 28, 2005

(54) MOORING DEVICE

(75) Inventors: John Mackay Hadcroft, Christchurch (NZ); Peter James Montgomery, Christchurch (NZ)

(73) Assignee: Mooring Systems Limited, Christchurch (NZ)

( * ) Notice: Subject to any disclaimer, the term of this patent is extended or adjusted under 35 U.S.C. 154(b) by 0 days.

(21) Appl. No.: 10/220,009

(22) PCT Filed: Feb. 26, 2001

(86) PCT No.: PCT/NZ01/00026

§ 371 (c)(1),
(2), (4) Date: Jan. 20, 2004

(87) PCT Pub. No.: WO01/62585

PCT Pub. Date: Aug. 30, 2001

(65) Prior Publication Data

US 2004/0154518 A1 Aug. 12, 2004

(Under 37 CFR 1.47)

(30) Foreign Application Priority Data

Feb. 26, 2000 (NZ) ..... 501395

(51) Int. Cl.[7] ..... B63B 21/00
(52) U.S. Cl. ..... 114/230.15; 114/230.18
(58) Field of Search ..... 114/230.1, 230.15, 114/230.16, 230.17, 230.18, 230.19

(56) References Cited

U.S. PATENT DOCUMENTS

| | | | | |
|---|---|---|---|---|
| 3,227,481 | A | | 1/1966 | Creskoff |
| 3,322,091 | A | | 5/1967 | Stanwick |
| 3,463,114 | A | | 8/1969 | Lovell |
| 3,974,794 | A | | 8/1976 | Kakitani et al. |
| 4,055,137 | A | | 10/1977 | Motai et al. |
| 4,532,879 | A | | 8/1985 | Ortloff |
| 4,543,070 | A | * | 9/1985 | Olsen et al. ..... 441/5 |
| 4,852,926 | A | | 8/1989 | Littell |
| 5,676,085 | A | | 10/1997 | Michl, Jr. |
| 6,439,147 | B2 | | 8/2002 | Cottrell et al. |
| 2001/0029879 | A1 | | 10/2001 | Cottrell et al. |

FOREIGN PATENT DOCUMENTS

| | | |
|---|---|---|
| DE | 25 57 964 | 12/1976 |
| DE | 92 07 648.3 | 10/1992 |
| EP | 55044057 | 3/1980 |
| EP | 58206478 | 12/1983 |
| FR | 2 672 650 | 8/1992 |
| GB | 1 491 511 | 11/1977 |
| JP | 55-44057 | 3/1980 |
| JP | 58-206478 | 12/1983 |
| JP | 61-218495 | 9/1986 |
| JP | 07033075 A | 2/1995 |
| JP | 08034388 A | 2/1996 |
| NL | 8600973 | 4/1986 |
| WO | 91/14615 | 10/1991 |
| WO | WO 98/17868 | 4/1998 |
| WO | WO 01/62584 A3 | 8/2001 |
| WO | WO 01/62584 A2 | 8/2001 |

* cited by examiner

*Primary Examiner*—Stephen Avila
(74) *Attorney, Agent, or Firm*—Knobbe, Martens, Olson & Bear, LLP

(57) ABSTRACT

A mooring robot releasably fastening a first moveable object (S) to a second nearby object. The first moveable object (S) moves in response to the application of external forces to the object (S). The robot operates to restore the first object (S) to a predetermined operating position. With the particular reference to the mooring of a vessel (S), the mooring robot has attractive attachment element(s) fixable to a ship's hull and includes a movement unit with active three-degree-of-freedom translation, for controlling the position of the attachment element(s). The movement includes a restorative means associated with each of the two degrees of translation freedom in the horizontal plane which provide a restorative force acting to return the attachment element(s) to the predetermined operating system.

25 Claims, 7 Drawing Sheets

MOORING DEVICE

This application is a National Phase in the United States of PCT/NZ01/00026 and claims the benefit of the New Zealand Application 501395 filed Feb. 26, 2000.

TECHNICAL FIELD

The present invention relates generally to mooring devices for releasably securing and retaining in position a large object in relation to a nearby second large object. More particularly, the present invention relates to robotic mooring devices for controlling the mooring and departure process for vessels from a fixed or floating dock, or from another vessel.

BACKGROUND ART

Whilst the invention relates to a mooring device for releasably securing and retaining in position a large object in relation to a nearby second large object, it will be described with reference to mooring devices for docking and undocking a vessel. However, it will be understood that the invention is not limited solely to such example.

The use of robot-like mooring devices has been proposed to reduce the labour intensity, hazards and time taken by using the traditional mooring lines. These devices should be capable of restraining movement of the ship in response to winds, currents, shifting tides, movement of the ship due to the addition or removal of cargo, and the like.

An example of such a device is shown in WO91/14615, which describes a mechanism with a prehensile assembly for engaging a bollard on the vessel. A disadvantage of this type of system is that the vessel must be specially adapted. Further, precision is required to align the two coupling components. The prehensile assembly is not adapted to be quickly disengaged during the departure process.

A known system of the applicants employs a mooring arm mounted within a ship to one end of which a vacuum cup is fixed. During mooring, the vacuum cup protrudes through an opening in the hull of the ship and attaches to a bearing plate. The bearing plate is fixed to the dock, but able to rise and fall freely relative to it. Such a system is significantly more efficient than the traditional mooring process but because of the bearing plate, it is only suited to applications where the ship has a dedicated dock. In addition, other means are provided for securing the vessel accurately in the fore and aft direction with respect to the dock. Where such is not the case, this inability to absorb forces acting on the vessel in the fore and aft direction and the necessity to provide a means of raising and lowering the dock mounted attachment plate is a disadvantage of this known system.

U.S. Pat. No. 3,974,794 illustrates an alternative dock mounted system which is able to handle a range of different vessels, with no modification to the vessel being necessary, since the vacuum cups bear on the ship's hull. Hydraulic cylinders are used to rotate the vacuum cup fixed to a dock to conform to the shape of the hull.

U.S. Pat. No. 3,463,114 describes a mooring device with a buffered telescopic boom fitted with a vacuum cup for engagement with the hull of a ship. The boom is fixed in vertical guides and it is allowed to rise and fall with the ship when fastened thereto.

In both of these systems (in U.S. Pat. Nos. 3,463,114 and 3,974,794) the ship is rigidly fixed to the mooring station in the longitudinal direction with respect to the ship, consequently the mooring device is subject to deleterious impact loads in this direction. Neither system may be used to control the position of the vessel in the fore-and-aft direction.

DE 2557964 illustrates a fending device with two dimensional movement and impact absorption. However there is no means for mooring a vessel, nor retain the moored vessel against a dock.

Generally, there are three degrees of freedom of the position of a floating vessel: fore-and-aft, rise-and-fall, and athwart-ship (and there are three degrees of freedom of its orientation or rotation: roll, pitch and yaw). When mooring a vessel, particularly a massive vessel, it is desirable to have a degree of compliance in the mooring device, to avoid impact loads which may occur in any direction. Additionally, when loading a vessel for example, it is often desirable to control and to vary the fore-and-aft position of the vessel relative to the dock, as well as to control the athwart-ship position.

It is an object of the present invention to provide a mooring device which automatically positions a first large object relative to a nearby second large object, with precise control of both the fore and aft and the athwart-ship position of the first object with respect to the second object, and which device reliantly buffers the mooring forces exerted between the two objects.

It is a further object of the present invention to provide a mooring device which provides increased control over the movement of the first large object relative to the second object, as compared with mooring devices known in the art.

It is a further object of the present invention to address the foregoing problems in respect of positioning a first large object relative to a second large object or to provide the public with a useful choice.

Further aspects and advantages of the present invention will become apparent from the ensuing description which is given by way of example only.

DISCLOSURE OF INVENTION

According to one aspect of the present invention there is provided a mooring robot for releasably fastening to a surface of a first moveable object, the mooring robot being mountable to a second object, said first object moving in response to the application of external forces, relative to the second object, which movement moves the first object from a pre-determined operating position, the mooring robot including:

an attractive attachment element for releasable engagement with said surface; and a movement unit, to which is pivotally secured the attractive element, said movement unit including a capability for three degrees of freedom of translational movement, which capability is translated through said attachment element to said surface to the first object, and wherein said unit includes mechanical means to provide resilient restorative forces associated with each of the two degrees of freedom of the movement in the horizontal plane;

wherein the resilient restorative means providing said restorative forces operates to return the attachment element and thus the first object to said predetermined operating position.

According to a further aspect of the present invention there is provided a mooring robot substantially as described above, wherein said second object is either moveable or fixed in location.

According to a further aspect of the present invention there is provided a mooring robot substantially as described above, wherein said first object is a sea vessel, and the second object is selected from: a fixed dock, a floating dock and a second vessel.

According to a further aspect of the present invention there is provided a mooring robot substantially as described above, wherein the said surface is the freeboard of a hull of a vessel. Optionally, the said surface may extend below the freeboard.

According to a further aspect of the present invention there is provided a mooring robot substantially as described above, wherein said first object is a selected from: a fixed dock, a floating dock and a first vessel and the second object is a vessel.

According to a further aspect of the present invention there is provided a mooring robot substantially as described above, wherein the restorative force is proportional to the displacement of the first object from the predetermined operating position in the horizontal plane.

According to a further aspect of the present invention there is provided a mooring robot substantially as described above, wherein the restorative means stores energy as the first object is displaced (in response to said external forces) from the pre-determined operating position, and releases said stored energy to return the first object back to the pre-determined operating position.

According to a further aspect of the present invention there is provided a mooring robot substantially as described above, wherein the attractive element comprises at least one vacuum cup having a circumferential elastomeric seal. The vacuum is preferably formed by a vacuum pump. Optionally, the mooring robot includes two vacuum cups.

According to a further aspect of the present invention there is provided a mooring robot substantially as described above, wherein the capability of the three degrees of freedom of movement of the movement unit are polar coordinate-type movement depending on one translational motion and two rotations.

Optionally, the capability of the three degrees of freedom of movement of the movement unit are of a Cartesian coordinate-type movement depending on three translational motions, a cylindrical coordinate-type movement depending on two translational motions and one rotation, and an articulation-type movement depending on three rotations.

According to a further aspect of the present invention there is provided a mooring robot substantially as described above, wherein the movement unit uses polar co-ordinate movement and comprises linear actuators arranged to provide the said one translational motion and two rotations.

According to a further aspect of the present invention there is provided a mooring robot as described above, wherein the linear actuators are fluid powered piston-and-cylinder units, or rams.

According to a further aspect of the present invention there is provided a mooring robot substantially as described above, wherein said rams are double-acting hydraulic rams, having fluid connections at both ends of their cylinders and providing linear force on both their extension and retraction strokes.

According to a further aspect of the present invention there is provided a mooring robot substantially as described above, wherein the restorative means comprises an hydraulic accumulator.

According to a further aspect of the present invention there is provided a mooring robot substantially as described above, wherein the movement unit further comprises:

a robot arm with a telescoping end, a vacuum cup assembly which is fixed to the telescoping end, said assembly including at least one vacuum cup; and a gimbal in which the robot arm is mounted.

Preferably, the gimbal is a universal type joint. Alternatively, the gimbal may be a spherical type joint.

Optionally, the movement unit further includes a mounting unit with limited movement in one direction;

shock absorbing means for absorbing forces between the attachment element and the mounting.

According to a further aspect of the present invention there is provided a mooring robot as described above, wherein the vacuum cup assembly is attached to the robot arm by a universal joint permitting limited rotation of the vacuum cup assembly relative to the robot arm perpendicular to the axis thereof.

According to a further aspect of the present invention there is provided a mooring system for releasably fastening a first moveable object to a second nearby object, said system including at least two mooring robots, each being substantially as described above.

According to a further aspect of the present invention there is provided a mooring system for releasably fastening a first moveable object to a second nearly object as described above, wherein said first object is a vessel and the second object is a dock, and wherein the mooring robots are mounted on the front face of and below the top of the dock and are retractable within a fender line fixed to the dock.

Optionally, the mooring robots may be mounted on the top of the dock or below the dock.

According to a further aspect of the present invention there is provided a mooring system for releasably fastening a first moveable object to a second nearby object as described above, wherein said first object is a vessel and the second object is a dock, and wherein the mooring robots are mounted on the front face of and below the top of the dock and are retractable within a fender line fixed to the dock.

According to another aspect of the present invention there is provided a mooring system including two or more mooring robots as described above wherein the control and monitoring of the mooring robots is performed by a control system linked to the ship's alarms.

Advantageously, this mooring device is simple and effective to operate and maintain, is free of interference with equipment and mechanisms utilised in the loading and unloading operations, and requires minimum care or adjustment when in use.

The mooring system also has the advantage of eliminating the need for close-in manoeuvring on departure from the dock as the mooring robots can be used to push a vessel clear of the dock. As with the mooring process, the departure is automated and can be remotely controlled.

Additionally, the use of resilient restorative forces in the horizontal plane and the resultant degree of control over vessel movement when docked, said vessel movement resulting from externally applied forces, is greatly increased over the prior art mooring devices.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
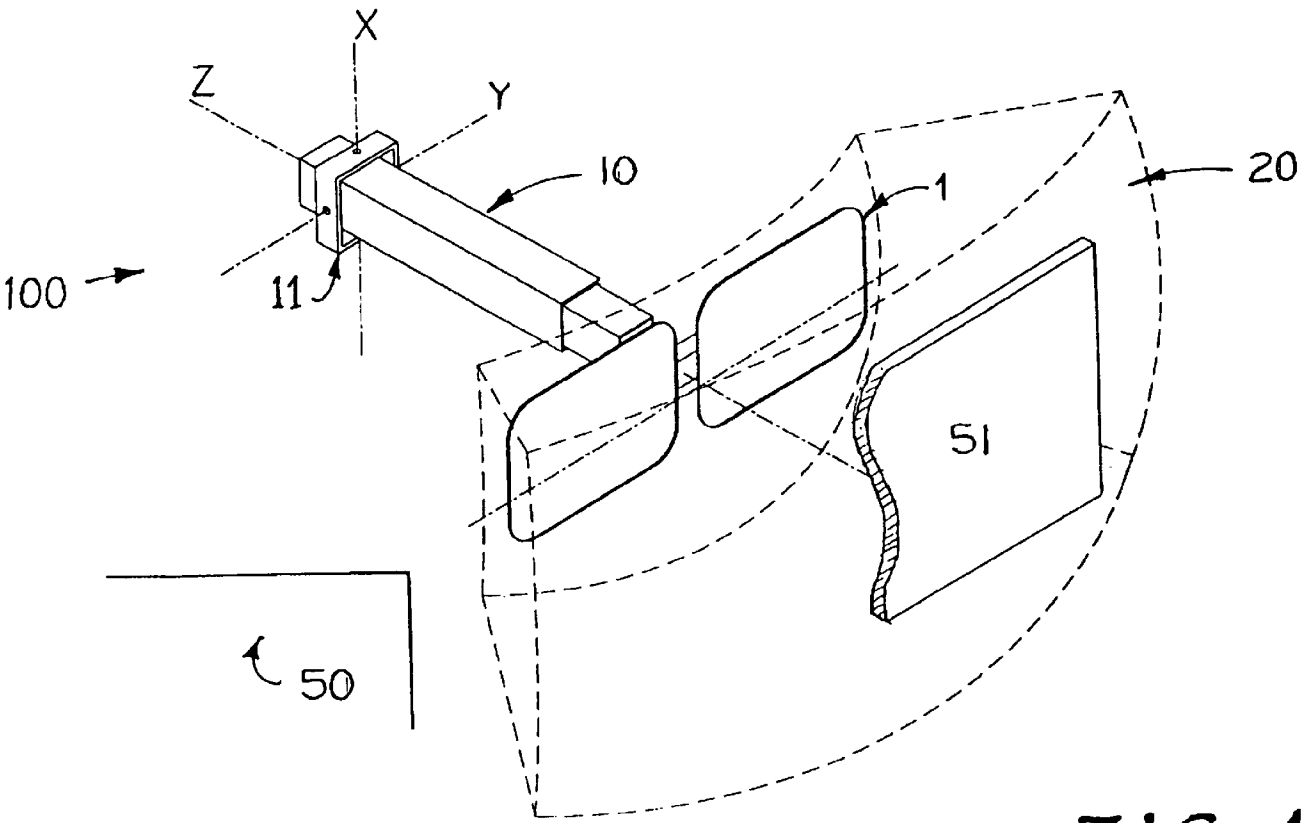
FIG. 1 is a three-dimensional schematic view of a robot arm a first preferred embodiment of a mooring robot of the present invention.

Referring to FIG. 1, a first preferred embodiment of a mooring robot 100 of the present invention (illustrated schematically) is fixed to a dock 50 and may be fastened to the hull 51 of a vessel by means of vacuum cups 1. The mooring robot 100 includes a robot arm 10, having three degrees of translational freedom for positioning the vacuum cups 1 anywhere within a three-dimensional operating envelope 20. The robot arm 10 provides a telescoping movement along axis Z and is fixed at one end in a gimbal 11 for rotation about two orthogonal axes X and Y, which are substantially vertical and horizontal respectively.

Figures 2, 3:
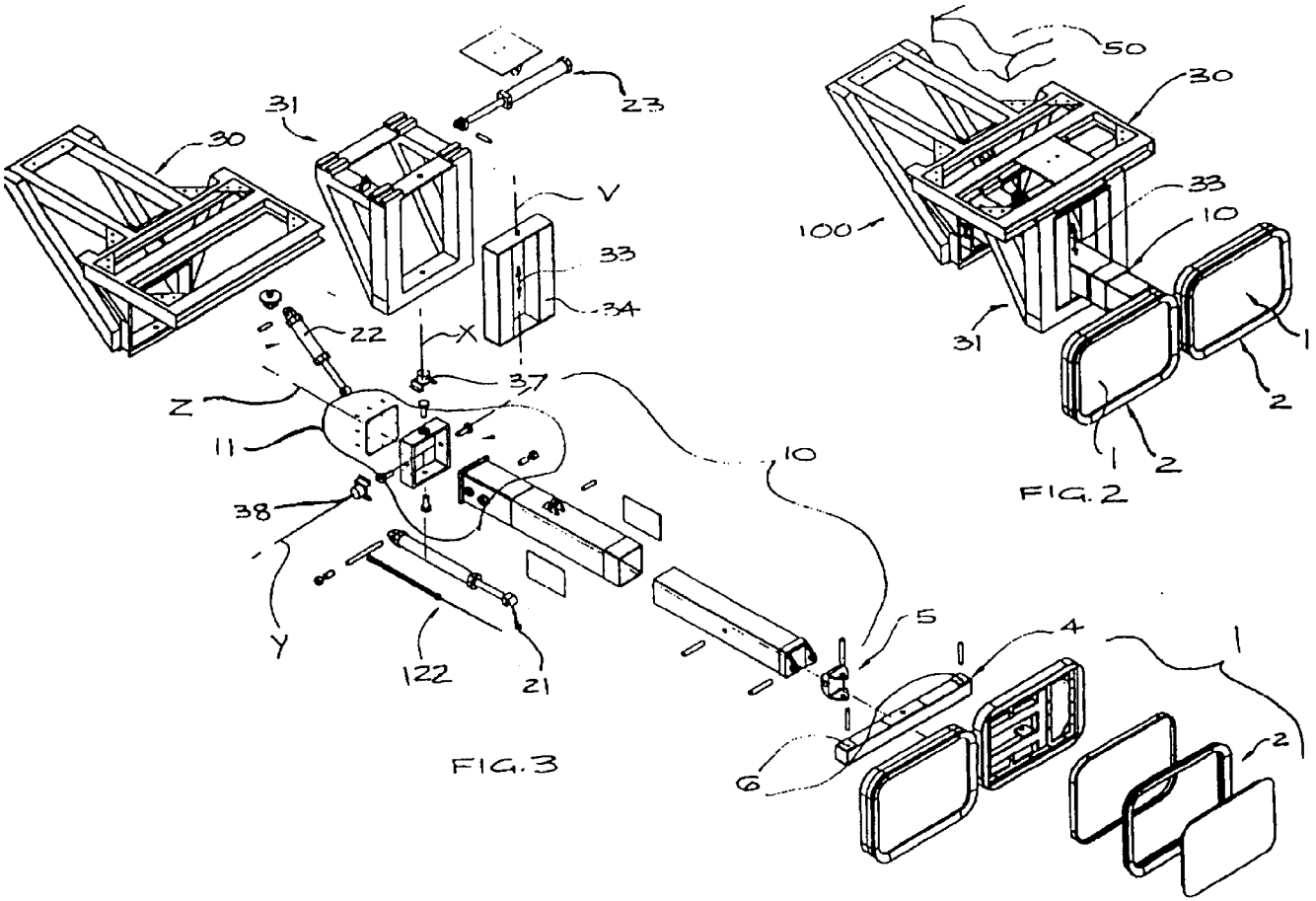
FIG. 2 is a pictorial view of the first preferred embodiment of the mooring robot of the present invention.
FIG. 3 is an exploded view of the mooring robot of FIG. 2.

FIG. 2 illustrates this first preferred embodiment of the mooring robot 100, which includes a mounting frame 30 fixed to the dock 50. The robot arm 10 is fixed by means of the gimbal 11 (FIG. 1) to the mounting frame 30, and protrudes through a vertically extending aperture 33 in a sub-frame 31 which is slidably connected to the mounting frame 30. The sub-frame 31 provides generally horizontal actuation of the robot arm 10 and has a limited degree of sliding movement along a horizontal axis relative to the mounting frame 30 and includes a pivotally mounted collar 34 (see also FIG. 3) defining the aperture 33.

FIG. 3 is an exploded view of the mooring robot 100, wherein each vacuum cup 1 has a circumferential seal 2 which is presented towards the hull 51 (FIG. 1). The seal 2 is of a type described in the co-pending U.S. patent application 10/220,010 which is based upon New Zealand Patent application No. 501394 (which description is incorporated herein by reference). Attached vacuum piping, valving, vacuum source and controls etc are not shown, for clarity. The vacuum cups 1 are arranged in a horizontal array supported by a horizontal member 4. Member 4 is a hollow section and also acts as a vacuum reservoir for the cups 1. In order to allow the vacuum cups 1 to conform to the shape of the hull 51 and to accommodate rotational displacement of the vessel, member 4 is mounted to the robot arm 10 about a universal joint 5, for rotations perpendicular to the axis of the robot arm 10. The collar 34 is pivotally fixed to the sub-frame 31 by bearings permitting rotation about a vertical axis V. The vacuum cups 1 are fixed to the member 4 by pivots 6 providing limited rotation of the vacuum pads 1 about a generally vertical axis.

The telescoping movement of the robot arm 10 is driven by a double acting hydraulic ram 21, having a position transducer 122. The robot arm 10 is pivoted about the axis Y to provide generally up and down movement of the vacuum cups 1. This is controlled by a double-acting hydraulic ram 22, both ends of which are pivotally fixed, one end to the mounting frame 30 the other end to the robot arm 10. Rotation about the axis Z generally provides fore-and-aft movement and is controlled by a double-acting hydraulic ram 23, one end of which is fixed to the mounting frame 30 the other end to the sub-frame 31. Rotary position transducers 37, 38 are fitted about the gimbal 11 for sensing rotation about axes X and Y respectively.

The hydraulic system (not shown) for actuating the rams 21 and 23 for controlling the position of the vacuum cups 1 in the horizontal plane includes a hydropneumatic accumulator for storing excess energy when the pressure in the rams 21 and 23 rises and releasing it when the pressure falls. Both sides of each double acting ram 21 and 23 are connected to the accumulator through control valving. The valving allows the accumulator to be cut in or out of the system as a whole and includes means for sensing which side of the ram 21 and 23 is pressurised by mooring forces and directing fluid from the pressurised side to the accumulator. Both sides of ram 22 are provided with valving which, when opened, allows fluid to flow freely to and from a hydraulic reservoir, thereby providing a "free-floating" operational mode.

Figure 4:
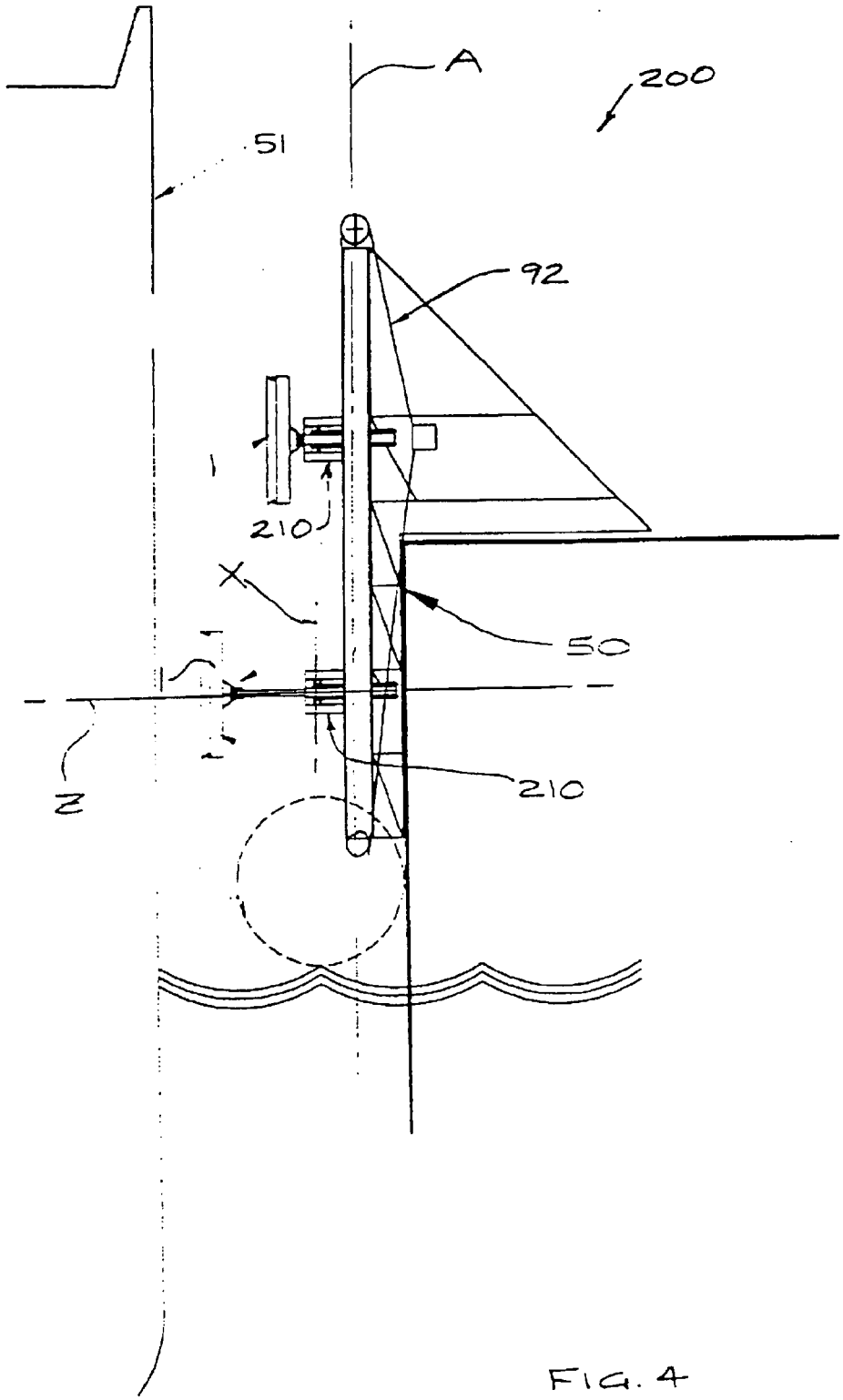
FIG. 4 is a side elevation of a second preferred embodiment mooring robot of the present invention.

A second preferred embodiment of the mooring robot 200 is shown in FIG. 4, wherein the three degrees of translational freedom are provided by means of a cylindrical coordinate-type movement depending on two translational motions and one rotation. A pair of robots 200 is shown, each having vacuum cups 1 connected to a telescopic robot arm 210 for linear movement along axis Z thereof. The robot arm 210 is pivotably fixed to a carriage (not shown) for rotation about a vertical axis X and the carriage itself may be moved along a vertical axis A.

Figure 5:
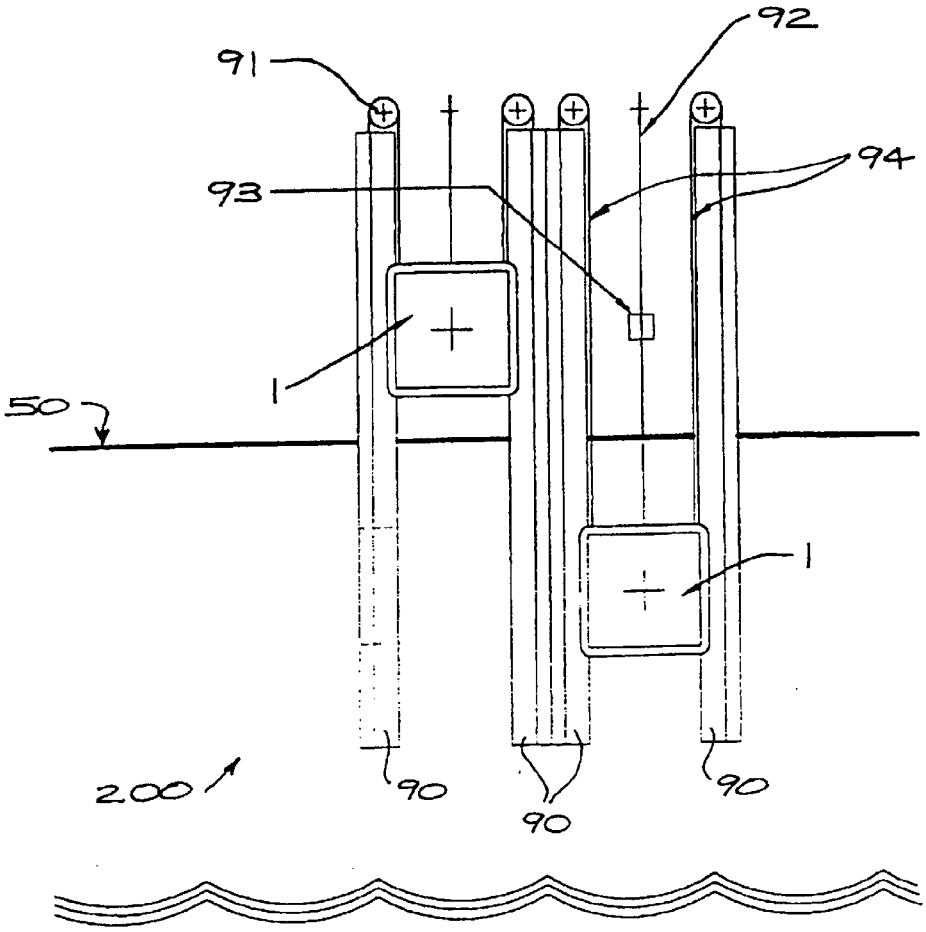
FIG. 5 is a front elevation of the mooring robot of FIG. 4.

FIG. 5 shows vertical columns 90, in which the carriage (not shown) moves, the columns 90 extend above and below the surface of the dock D. Each carriage is counterweighted by means of cables 94 fixed through pulleys 91 to counterweights (not shown), and is driven both up and down by means of a looped drive cable 92 connected to a winch 93.

Figure 6:
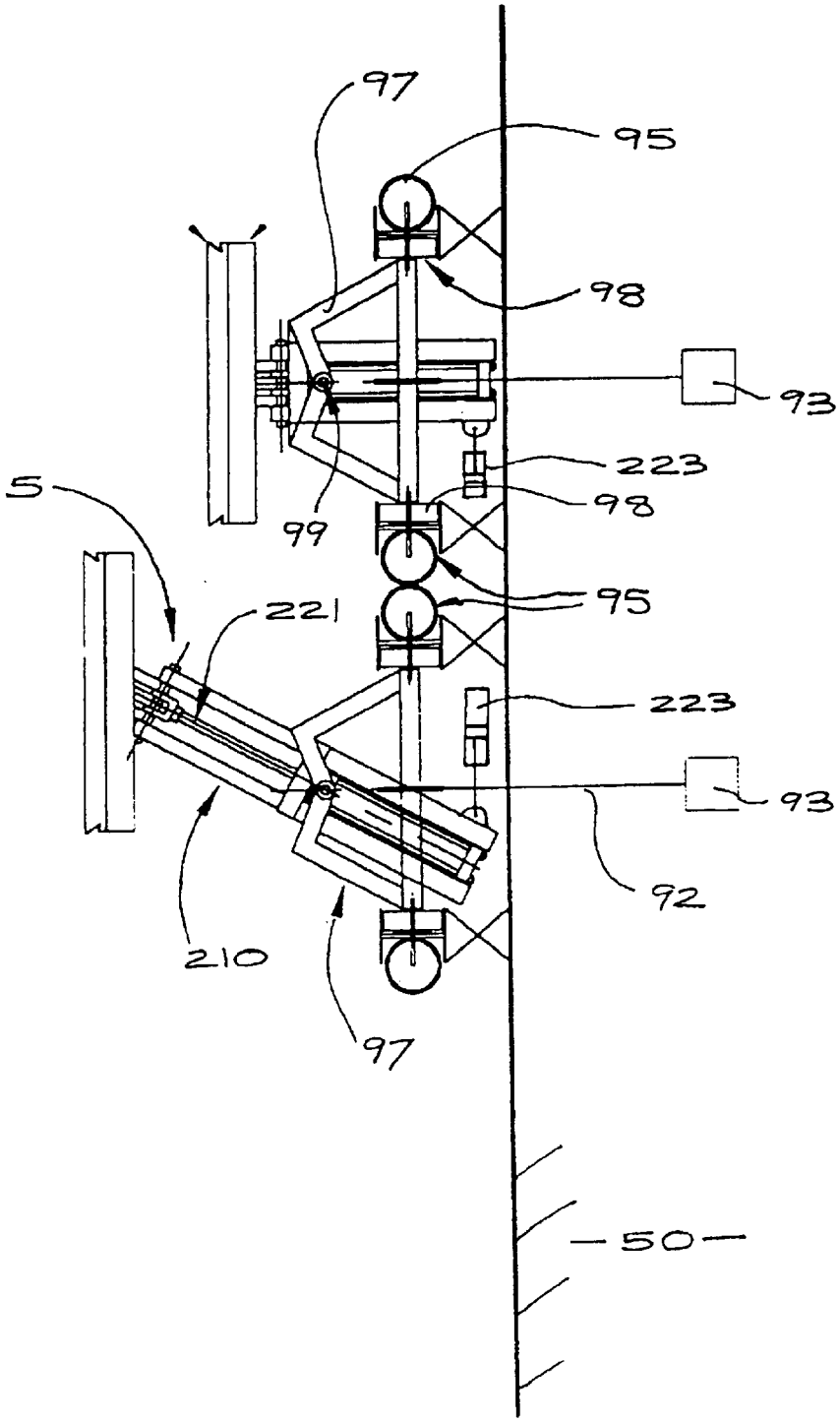
FIG. 6 is a plan view of the mooring robot of FIG. 4.

Referring to FIG. 6, adjacent to each column 90 is a tube 95 extending vertically and enclosing the counterweight (not shown). A pair of wheels 98 on either side of the carriage 97 carry it in the column 90. The carriage 97 has a pivot 99, defining axis X, about which the robot arm 10 is pivoted by means of a double-acting hydraulic ram 223. The robot arm 210 is telescoped by a double-acting hydraulic ram 221. The rams 221, 223 are connected to a hydropneumatic accumulator, in the manner described above.

Figure 7:
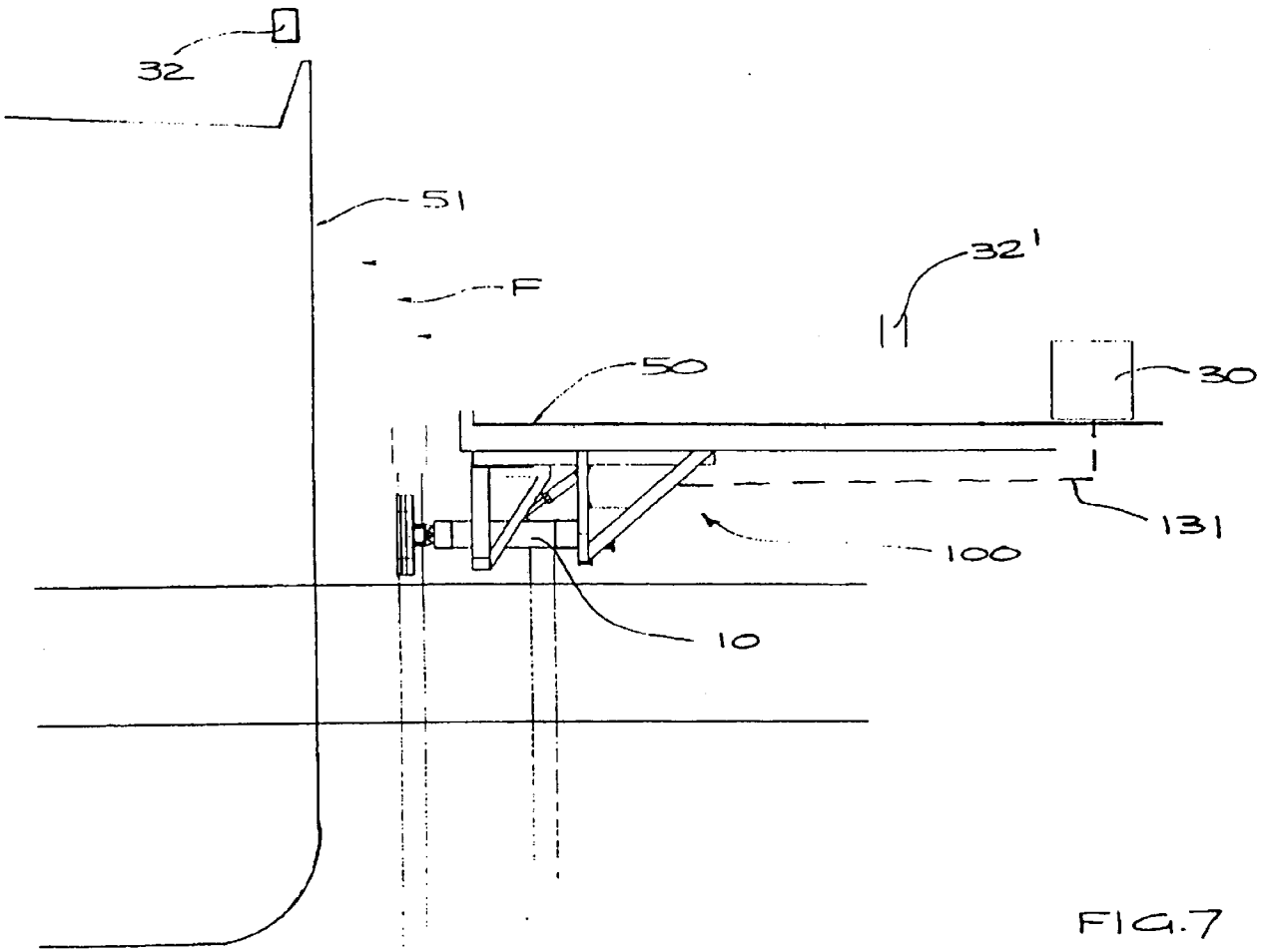
FIG. 7 is a side elevation of the first preferred embodiment of the mooring robot fixed to a dock.

With reference to FIG. 7, the first preferred embodiment of the mooring robot 100 is shown mounted to a fixed dock 50. A range of sizes of ship S may be accommodated by the dock 50, which may be fixed or floating.

A mooring system 500 preferably includes two or more mooring robots 100, as described above. Optionally the mooring system may include robots 200 or both robots 100 and 200. Optionally energy-absorbing fenders F, of the known type may be retained at intervals along the front face of the dock 50. The mooring robots 100 are mounted on the front face and below the top of the dock 51 so as not to interfere with loading and unloading operations. It will be appreciated that the mooring system 100 may equally be fixed to a ship S, permitting the ship S to be made fast to a surface attached to the dock 51 or another ship S.

In the mooring system 500 several mooring robots 100 are connected by service lines 131 to a single power/control unit 30 mounted on the dock 50. The power/control unit 30 provides control signals to the mooring robot 100 and provides means to power the rams 21, 22, 23 (FIG. 3) and the vacuum cups 1 (FIGS. 1–3). It also receives feedback signals indicating the operating conditions of each mooring robot 100. Positional feedback indications from the mooring robot 100 can be provided to other systems, for example, automatic loading systems which require information on the position of the ship S. Preferably the mooring system 100 operates automatically in the sequence to be described below, this operation being controlled remotely from the shore or the ship S by a unit 32.

Figure 8:
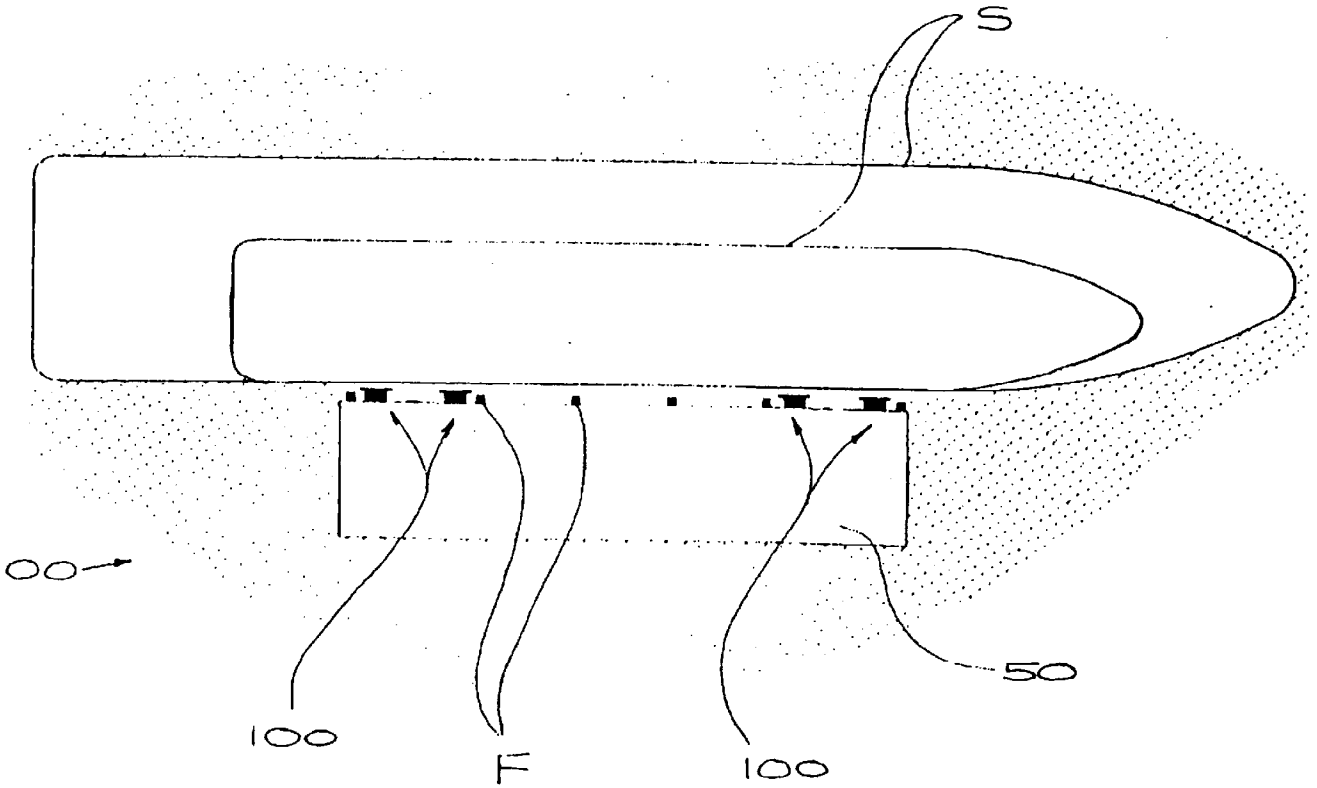
FIG. 8 is a plan view of mooring device of the present invention.

The operation of the mooring robot (100, 200) is described herein below with reference to FIGS. 7 and 8. To make fast a ship S the mooring arm (10, 210) is extended generally perpendicular to the front mooring face of the docked area In operation, when the ship S draws near to the dock 50, the robot arm (10, 210) extends the vacuum cups 1 out toward the hull of the ship S. The ship S is positioned so that the vacuum cups 1 engage a planar section of the hull.

The assumption that the ship side is substantially planar is not critical to the operation of the mooring robot (100, 200) since the pivots (5, 3) allow the vacuum cups 1 to rotate to conform to the curve of the hull of the ship S. Although some vessels have slightly rounded sides for greater seaworthiness, for most container ships (in particular) this assumption is valid, except possibly near the bow and stern of the ship. This is because ships designed to stow containers have flat sides to use the space efficiently, and the bow and stern of the ship are not used for mooring.

Sensors of a known type (not shown) indicate engagement with the hull. The vacuum cups 1 are then actuated to fasten to the ship S in the known manner. With both mooring robots (100, 200) fixed, the ship S is automatically moved into a docked position (not shown) maintaining it at a pre-set (but variable) distance clear of the dock 50. This position is the preferred, or pre-determined operating position.

Referring to the first preferred embodiment, and FIGS. 1–3, the operation of each mooring robot 100 maintains the ship S, within certain limits in the docked position in response to changing conditions of wind, tide, swell and displacement. If each mooring robot 100 is too rigid to allow movement of the ship S fore-and-aft, athwart ship and also in pitch, roll, and yaw, then failure of the vacuum in the cups 1, or of the ship's hull could occur.

On attaining the docked position (or pre-determined operating position), the hydraulic pumps for actuating the rams (21, 22, 23) are stopped, the accumulator is cut into the lines to the ram 21 and 23 and the vertical movement ram 22 is switched into free-floating mode allowing the mooring robot (and thus the ship S) to rise and fall with the tide, state of loading, etc. Once in the docked position, pressure is regulated on each side of the piston of the rams 21 and 23 such that movement of the robot arm 10 in any direction in the horizontal plane away from the docked position results in a proportional force acting to restore the arm 10 to the pre-determined operating position, and thus return the ship S to the docked position.

Movement in the horizontal plane from the predefined docked position will result in pressurising of the fluid in the accumulator which provides hydraulic pressure to the rams (21, 23) tending to restore the arm 10 to the pre-determined operating position and thus the ship S to the docked position. The maximum ram pressure, and hence the maximum load able to be applied to the vacuum cups 1, is limited to a level safely below the load capacity of the vacuum cups 1. Under severe conditions, if the travel of the rams 21, 22, 23 approaches its limit under maximum operating pressure, an alarm condition is indicated, allowing the ship's captain or port authorities to take emergency action. All other operating conditions are also monitored and preferably linked to the ship's alarms.

The ram 22 permits the ship S to rise and fall relative to the dock 51. Optionally, the method of mooring the ship S includes a first step of initially selecting the height of the vacuum cups 1, depending on the state of the tide and state of loading of the ship S. The ram 22 is then operated to move the cups 1 to that height. In this way the vertical travel necessary to accommodate the full range of ships S may be reduced.

Referring to FIGS. 4 & 5, in the operation of the second preferred embodiment of the mooring robot 200, the resilient action in the horizontal plane is accomplished in a similar manner to that described above for the first preferred embodiment of the mooring robot 100. The two rams 221 and 223 are connected to an accumulator. Vertical movement of the carriage 97 is controlled by allowing the mooring robot 200 to rise and fall freely. It will be appreciated that the mooring robot 200, as compared to mooring robot 100, provides an increased vertical range of operation and is thereby able to accommodate a wider variations in this direction, due to load and tidal flow etc.

The mooring robots 100, 200 may optionally include means for absorbing and/or resiliently buffering substantially vertical mooring forces for providing the increased stability, particularly with respect to roll and pitch of the ship S. For example, this may be provided by means of shock absorbers (not shown) connected to the robot arm 10 or may be provided through the actuating elements controlling vertical movement—the ram 22 and winch/cable 92, 93 in the two preferred embodiments respectively.

Even providing for the resilience as described, the ship S is more rigidly held in the docked position by these mooring systems (100, 200) than by the traditional (mooring line) method. Also, not only are paint abrasion and impact damage to the ship S prevented, but this increased stability is also advantageous when transferring cargo between the ship S and shore. Additionally, it has been found in practice that the mooring system (100, 200) consumes less energy to moor a ship S than systems using automatic tensioning devices to control mooring lines.

The mooring system (100, 200) also eliminates the need for close-in maneuvering on departure from the dock 51 as the mooring robot 100 can be used to push the ship S clear of the dock 51 As with the mooring process, the departure is automated and remotely controlled by the unit 30.

Whilst the invention has been described with reference to a fixed dock 50, it will be appreciated that the dock may be a floating dock or that the dock may be replaced by a second vessel. Similarly the above invention has been described with the mooring system 500 afixed to the dock 51. It will be appreciated that the mooring system may be afixed to the movable vessel.

Similarly, the above embodiment of the invention as embodied in a docking system for vessel, it will be appreciated that there are other applications for the invention; for example the docking of one object to another under water, or in other environments. In such situations it will be apparent that he use of the term 'horizontal' plane is not limiting; but is used by way of reference to assist in defining the plane of restorative movement relative to the orientation of the object being dock and/or relative to any constant force (in the example above, gravity)

Aspects of the present invention have been described by way of example only and it should be appreciated that modifications and additions may be made thereto without departing from the scope thereof.

What is claimed is:

1. A mooring robot for releasably fastening to a vessel, the mooring robot being fixable to a mounting, wherein the mounting is either a fixed or floating dock or a second vessel, the mooring robot comprising:

an attractive attachment element for releasable engagement with a surface for making fast the vessel;

a three axis translation unit mounted at the mounting and acting on an arm at one end of which the attractive element is fixed, the translation unit providing power-actuated translational movement to the arm to provide the displacement thereby of the attachment element in three dimensions;

at least one actuator driving the arm to thereby displace the attachment element in a horizontal plane so as to move the vessel relative to the mounting in both the fore-and-aft and athwartship directions, the actuator being releasable from a driving condition to the arm to allow external forces to displace the vessel and the attachment element relative to the mounting in the horizontal plane from a selected moored position; and resilient means acting on the arm so as to resiliently bias the vessel and the attachment element toward the selected moored position, the resilient means acting in both the fore-and-aft and athwartship directions.

2. The mooring robot of claim 1, wherein the resilient means operates when the at least one actuator is released from the driving condition, the mooring robot further comprising a vertical actuator fixed to the translation unit for driving the arm to thereby displace the attachment element vertically, and wherein the vertical actuator is releasable from a driving condition to the arm to allow the vessel and the attachment element to freely rise and fall relative to the mounting.

3. The mooring robot of claim 1, wherein the resilient means provides a restorative force proportional to the displacement of the attachment element in the horizontal plane from the selected moored position.

4. The mooring robot of claim 3, wherein the resilient means releases energy to restore the attachment element to the selected moored position, the energy being stored during displacement of the attachment element from the selected moored position.

5. The mooring robot of claim 1, wherein said surface is the freeboard of the hull of a floating vessel.

6. The mooring robot of claim 1, wherein the attractive attachment element comprises at least one vacuum cup having a circumferential elastomeric seal.

7. The mooring robot of claim 1, wherein the arm is telescopically mounted from the translation unit so as to allow linear translational motion of the attachment element in a horizontal direction in the horizontal plane, the robot arm being mounted by the translation unit in a pivoted manner about a substantially vertical axis.

8. The mooring robot of claim 2, wherein said vertical actuator and at least one actuator comprise linear actuators and are fixed to the translation unit for driving the arm to displace the attachment element.

9. The mooring robot of claim 7, wherein said vertical actuator and at least one actuator comprise linear actuators and are fixed to the translation unit for driving the arm to displace the attachment element.

10. The mooring robot of claim 7, wherein the arm is mounted for sliding in vertical guides of the translation unit.

11. The mooring robot of claim 8, wherein the linear actuators are double-acting hydraulic rams.

12. The mooring robot of claim 10, further comprising a counterbalance counterbalancing a substantial portion of the weight of the arm.

13. The mooring robot of claim 7, wherein the attachment element further comprises a vacuum cup and vacuum cup mounting assembly fixed to a distal end of the telescoping arm.

14. The mooring robot of claim 13, wherein the vacuum cup mounting assembly is attached to the arm by a universal joint permitting limited rotation of the attractive element relative to the arm and perpendicular to the axis thereof.

15. The mooring robot of claim 1, wherein the mounting is a dock and wherein the mooring robot is mounted on the front face of and below the top of the dock and is retractable within a fender line of the dock.

16. The mooring robot of claim 8, wherein the linear actuators are double-acting hydraulic rams.

17. The mooring robot of claim 1, wherein the translation unit comprises shock absorbing means for absorbing mooring forces between the attachment element and the mounting.

18. The mooring robot of claim 1, wherein said surface is fixed relative to said mounting.

19. The mooring robot of claim 1, wherein the three dimensions comprise two substantially perpendicular axes of rotation and a translational axis arranged substantially perpendicular to the plane of the two axes of rotation.

20. A mooring system comprising at least two mooring robots for releasably fastening a vessel, each said robot being fixable to a mounting, wherein the mounting is either a fixed or floating dock or a second vessel, the mooring robot comprising:

an attractive attachment element for releasable engagement with a surface for making fast the vessel;

an arm;

a three axis translation unit mounted at the mounting and acting on the arm at one end of which the attractive element is fixed, the translation unit providing power-actuated translational movement to the arm to provide the displacement thereby of the attachment element in three dimensions;

at least one actuator driving the arm to thereby displace the attachment element in a horizontal plane so as to move the vessel relative to the mounting in both the fore-and-aft and athwartship directions, the actuator being releasable from a driving condition to the arm to allow external forces to displace the vessel and the attachment element relative to the mounting in the horizontal plane from a selected moored position; and resilient means acting on the arm so as to resiliently bias the vessel and the attachment element toward the selected moored position, the resilient means acting in both the fore-and-aft and athwartship directions; and a power/control unit monitoring and controlling the operating condition of each mooring robot.

21. The mooring system of claim 20 wherein the power/control unit monitoring and controlling each mooring robot is linked to alarms of the vessel.

22. The mooring system of claim 20, wherein the three dimensions comprise two substantially perpendicular axes of rotation and a translational axis arranged substantially perpendicular to the plane of the two axes of rotation.

23. The mooring system of claim 20, further comprising a remote control unit configured to remotely control operation of the mooring system.

24. The mooring system of claim 23, wherein the remote control unit is arranged on a dock.

25. The mooring system of claim 20, wherein the power/control unit is connected to the mooring robots via service lines.

* * * * *

UNITED STATES PATENT AND TRADEMARK OFFICE

CERTIFICATE OF CORRECTION

PATENT NO. : 6,910,435 B2
DATED : June 28, 2005
INVENTOR(S) : Hadcroft et al.

It is certified that error appears in the above-identified patent and that said Letters Patent is hereby corrected as shown below:

Column 10,
Delete claim 16, lines 9-10.

Signed and Sealed this

Twenty-seventh Day of December, 2005

JON W. DUDAS
*Director of the United States Patent and Trademark Office*